US005515840A

United States Patent [19]

Jang

[11] Patent Number: 5,515,840

[45] Date of Patent: May 14, 1996

[54] FUME EXHAUSTING DEVICE

[76] Inventor: Sun-Sing Jang, 650, Yuan-Huan E. Rd., Fong-Yuan, Taichung Hsien, Taiwan

[21] Appl. No.: 393,916

[22] Filed: Feb. 24, 1995

[51] Int. Cl.[6] ..... F24C 15/20

[52] U.S. Cl. ..... 126/299 R; 126/299 D

[58] Field of Search ..... 126/299 R, 299 D

[56] References Cited

U.S. PATENT DOCUMENTS 5,063,906 11/1991 Rogers et al. ..... 126/299 D

*Primary Examiner*—Carroll B. Dority

*Attorney, Agent, or Firm*—Browdy and Neimark

[57] ABSTRACT

A fume exhausting device comprises a housing in which an air flow guiding box and a transverse impeller are disposed. The air flow guiding box is formed by a front plate, a top plate, a rear plate, a left plate and a right plate. The top plate is provided with an opening. The transverse impeller is located horizontally in the air flow guiding box such that the impeller is pivoted respectively at the left end thereof and the right end thereof to the left plate and the right plate of the air flow guiding box, and that the impeller is driven by the motor. A bottom plate is fastened to the housing such that the opening of the front plate of the air flow guiding box is sealed off by the bottom plate which is provided with a plurality of ventilation holes.

24 Claims, 9 Drawing Sheets

FIG. 6
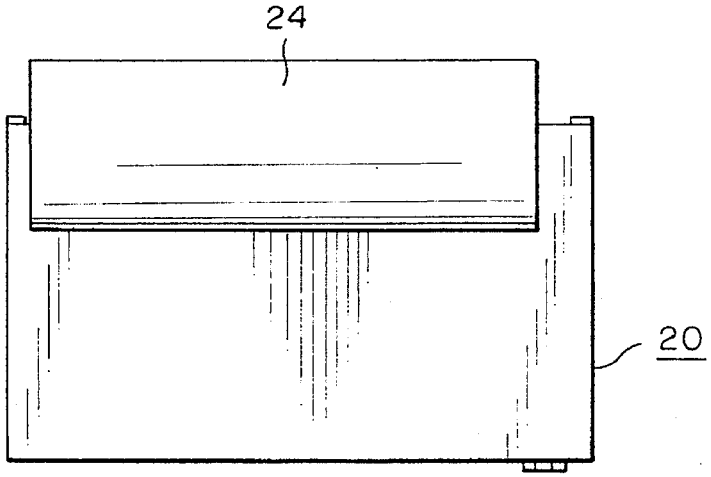
FIG. 7
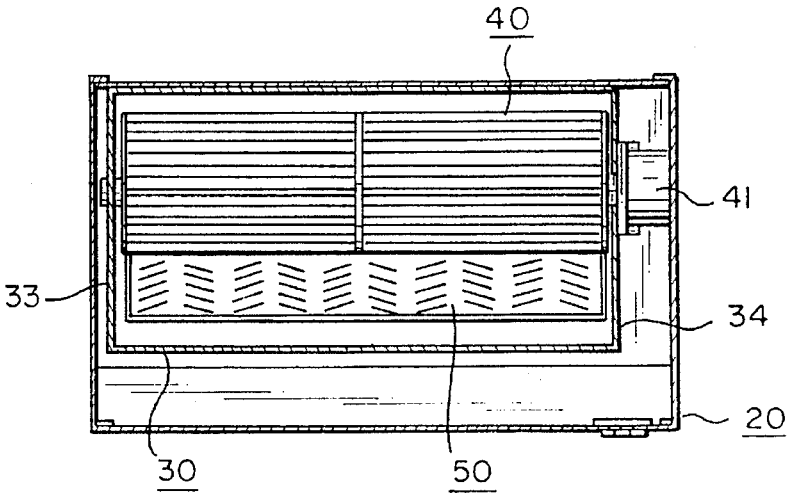
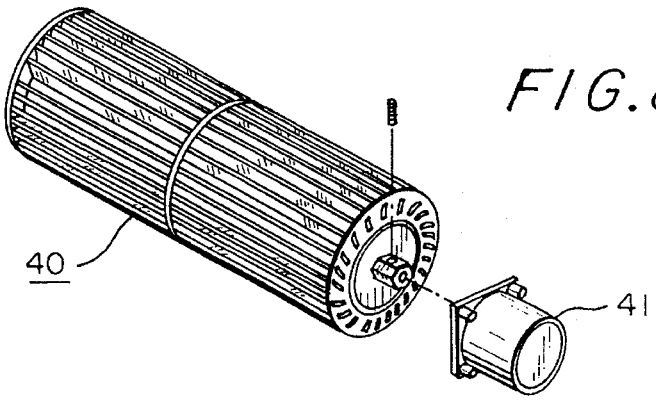
FIG. 8

FIG. 9
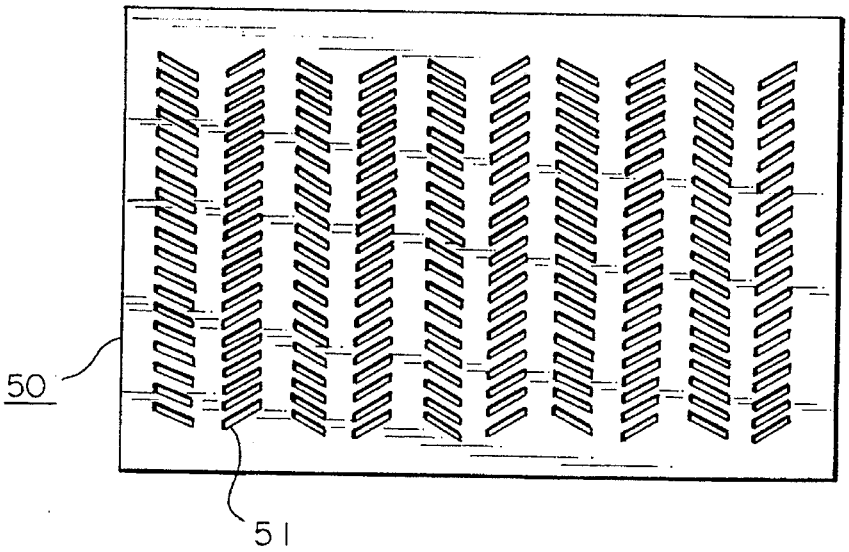
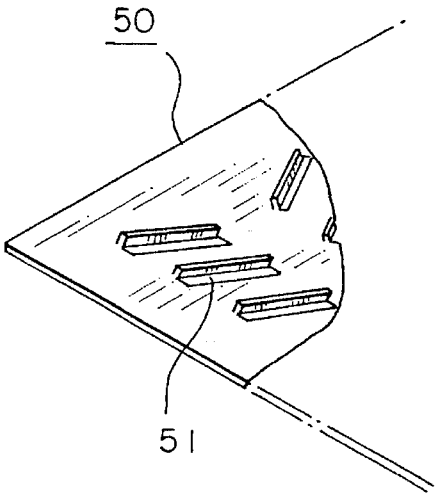
FIG. 10

FUME EXHAUSTING DEVICE

FIELD OF THE INVENTION

The present invention relates generally to a fume exhausting device, and more particularly to a fume exhausting device for use in a kitchen.

BACKGROUND OF THE INVENTION

As shown in FIGS. 1–3, a kitchen smoke exhausting device of the prior art comprises mainly a housing 10, a bellows 11, a motor 12, an impeller 13, a motor housing 14, a grease collecting tray 15, a liner 16, a bottom plate 17, a grease collecting cup 18, and a smoke discharging pipe 19. It is readily apparent that such a prior art kitchen smoke exhauster as described above comprises many component parts and is rather complicated in construction. In other words, the prior art kitchen smoke exhauster described above is not cost-effective.

SUMMARY OF THE INVENTION

It is therefore the primary objective of the present invention to provide a fume exhausting device which is simple in construction and can be made economically.

It is another objective of the present invention to provide a fume exhausting device which is effective in exhausting the cooking fume.

The foregoing objectives of the present invention are attained by a fume exhausting device comprising a housing in which an air flow guiding box and a transverse impeller are disposed. The air flow guiding box is formed by a front plate, a top plate, a rear plate, a left plate, and a right plate. The top plate is provided with an air exit while the front plate is provided with an opening. The transverse impeller is located horizontally in the air flow guiding box such that the impeller is pivoted respectively at the left end thereof and the right end thereof to the left plate and the right plate of the air flow guiding box, and that the impeller is driven by a motor. A bottom plate is fastened to the housing such that the opening of the front plate of the air flow guiding box is sealed off by the bottom plate, which is provided with a plurality of ventilation holes.

The present invention may best be understood through the following description with reference to the accompanying drawings, in which:

BRIEF DESCRIPTION OF THE DRAWINGS

FIG. 6 shows a top plan view of the first preferred embodiment as shown in FIG. 4;

FIG. 7 shows a sectional view of a portion taken along the line 7—7 as shown in FIG. 5;

FIG. 8 shows a perspective view of an impeller of the fume exhausting device of the present invention;

FIG. 9 shows a front view of a bottom plate of the fume exhausting device of the present invention;

FIG. 10 shows a perspective view of an inside of the bottom plate of the fume exhausting device of the present invention;

DETAILED DESCRIPTION OF THE EMBODIMENTS

Figure 1:
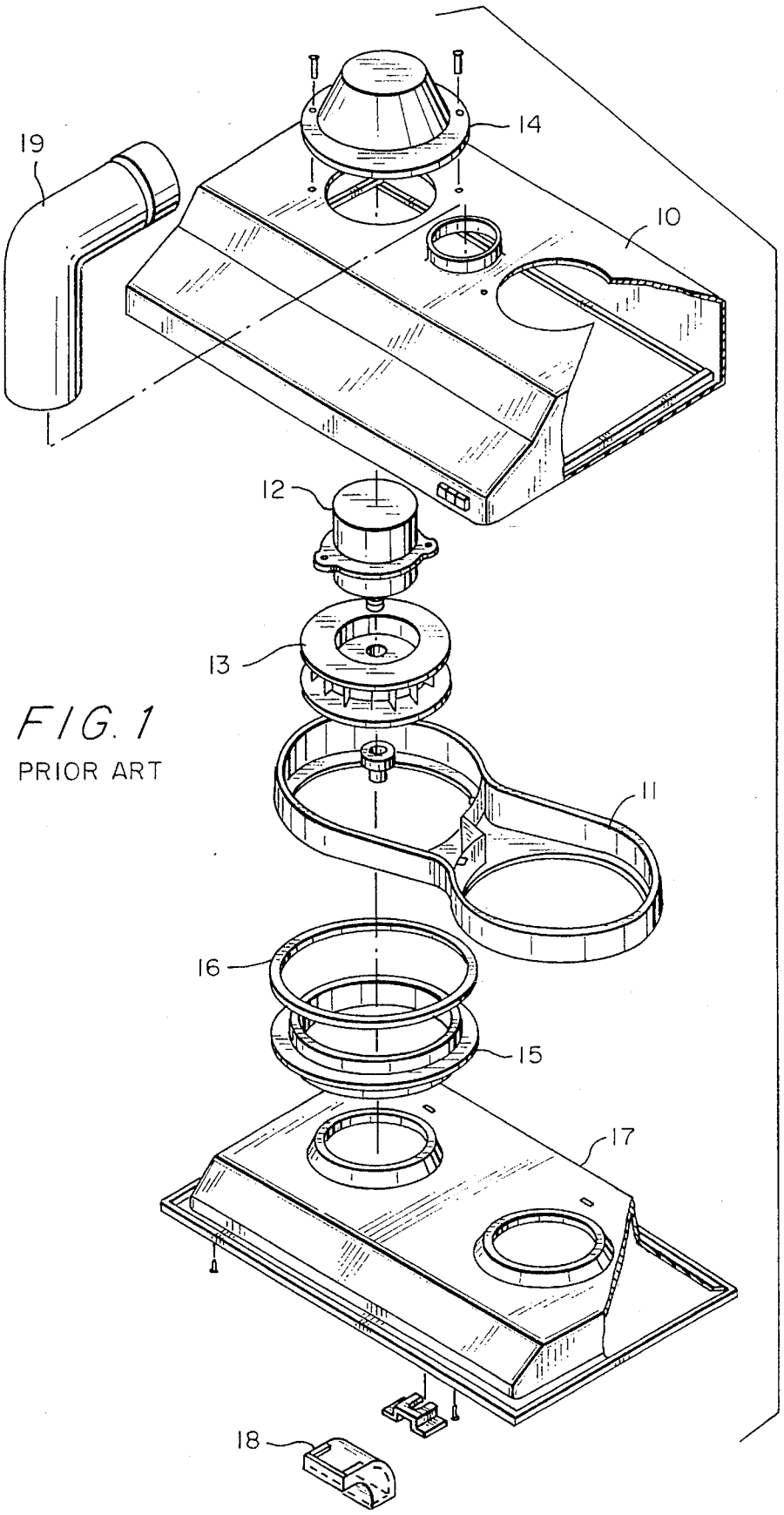
FIG. 1 PRIOR ART
FIG. 1 shows an exploded view of a kitchen smoke exhauster of the prior art.
Figure 2:
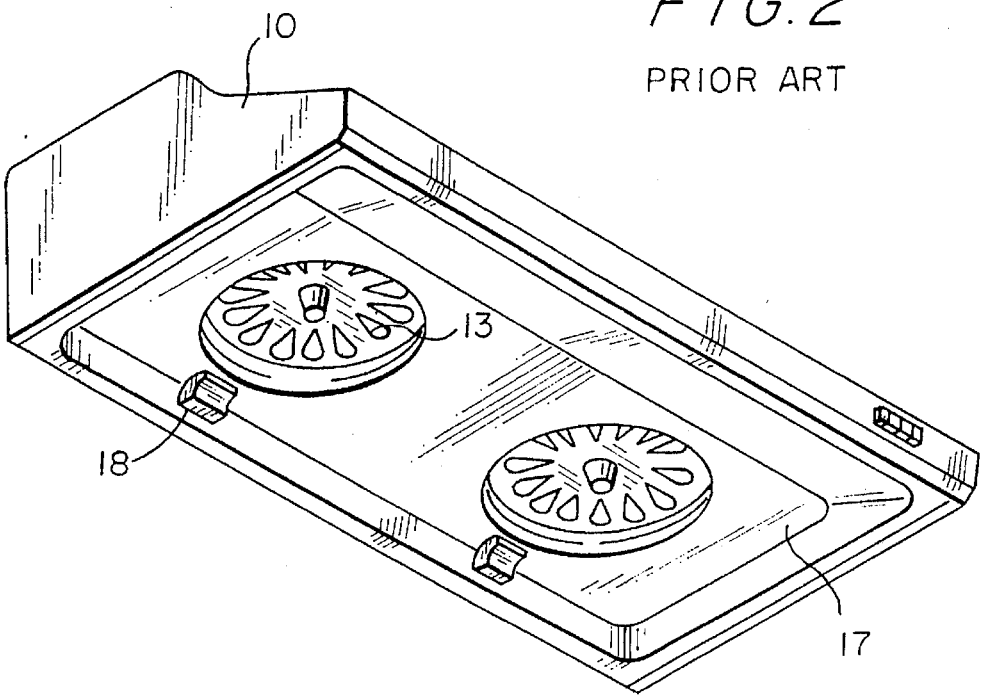
FIG. 2 PRIOR ART
FIG. 2 shows a bottom perspective view of the prior art kitchen smoke exhauster in combination.
Figure 3:
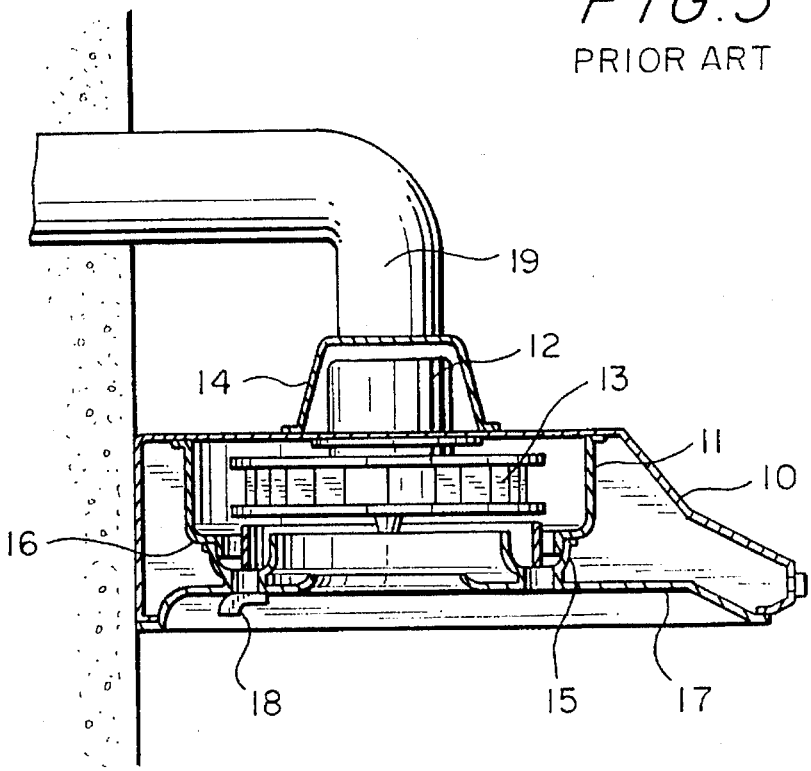
FIG. 3 PRIOR ART
FIG. 3 shows a front-rear sectional view of the prior art kitchen smoke exhuaster in combination.
Figure 4:
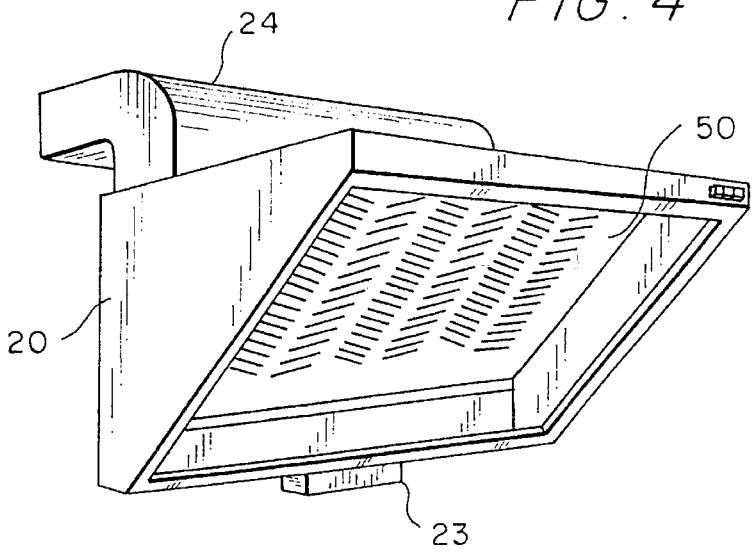
FIG. 4 shows a perspective view of a first preferred embodiment of the present invention.
Figure 5:
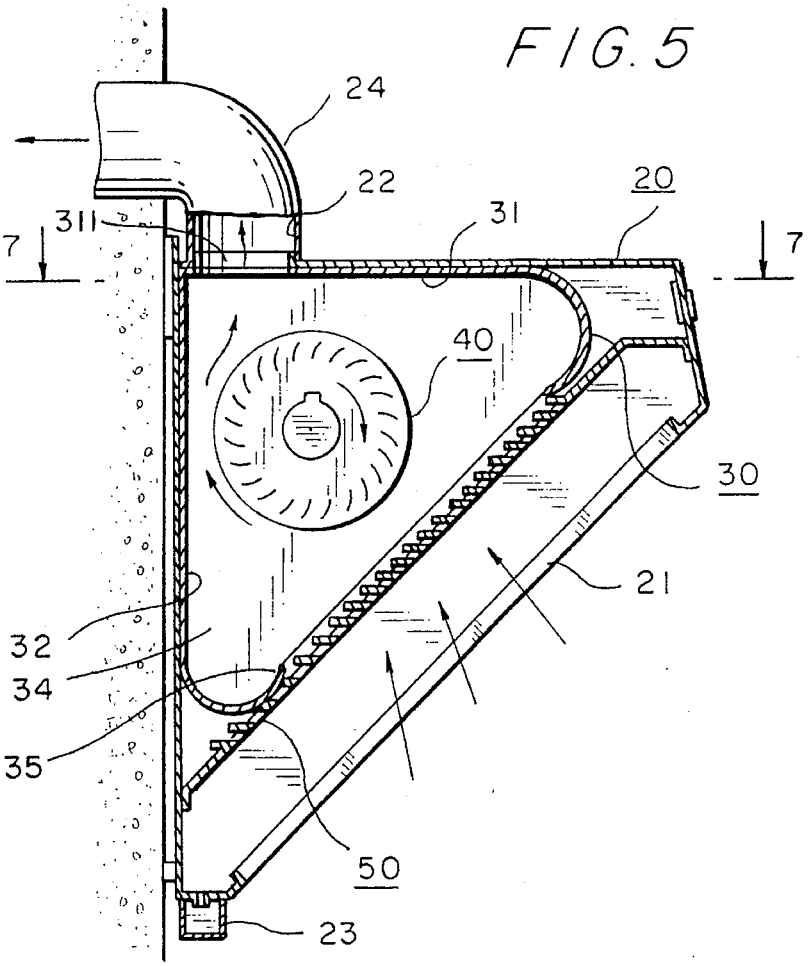
FIG. 5 shows a front-rear sectional view of the first preferred embodiment in combination according to the present invention.

Referring now to FIGS. 4–10, a first preferred embodiment of a fume exhausting device according to the present invention includes a housing 20, an air flow guiding box 30, a transverse impeller 40 and a bottom plate 50.

The housing 20 is provided at the front side thereof with a square opening 21 slanting toward the rear of the housing 20 and is further provided at the top thereof with a rectangular exit 22. In addition, the housing 20 is provided at the bottom thereof with a grease collecting cup 23.

The air flow guiding box 30 is located in the interior of the housing 20 and is made up of a top plate 31, a rear plate 32, a left plate 33 and a right plate 34. The left and the right plates 33 and 34 are kept respectively a predetermined distance away from the left and the right sides of the housing 20. The air flow guiding box 30 further comprises a front plate 35. The top plate 31 is provided rearwards an air exit 311 corresponding in location to the rectangular exit 22 of the housing 20.

The transverse impeller 40 of a dual-section type is pivoted respectively at two ends thereof to the left and the right plates 33 and 34 such that the impeller 40 can be driven by a motor 41.

The bottom plate 50 is disposed in the housing 20 such that an opening of the front plate 35 of the air flow guiding box 30 is sealed off by the bottom plate 50. The bottom plate 50 is provided with a plurality of ventilation holes 51 of a rectangular shape.

In operation, the impeller 40 is actuated by the motor 41 to rotate so as to bring about a suction effect capable of drawing completely the cooking fume into the air flow guiding box 30 via the ventilation holes 51 of the bottom plate 50. The cooking fume is subsequently let out of the kitchen via a fume discharging pipe 24 located at the top of the housing 20. The suction effect of the fume exhausting device of the present invention is different from the suction effect of the smoke exhauster of the prior art in that the former is capable of exhausting the fume completely, and that the suction effect of the latter is brought about by two impellers 13 capable of generating two circular smoke-exhausting areas which are rather ineffective in drawing off the cooking fume.

Figure 11:
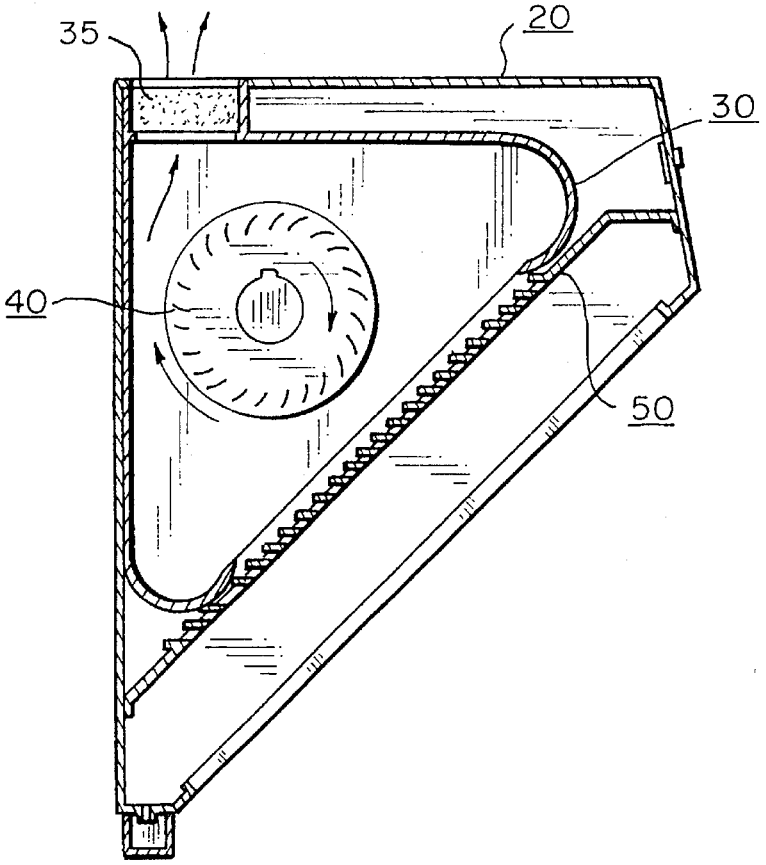
FIG. 11 shows a schematic view of a second preferred embodiment of the present invention.
Figure 12:
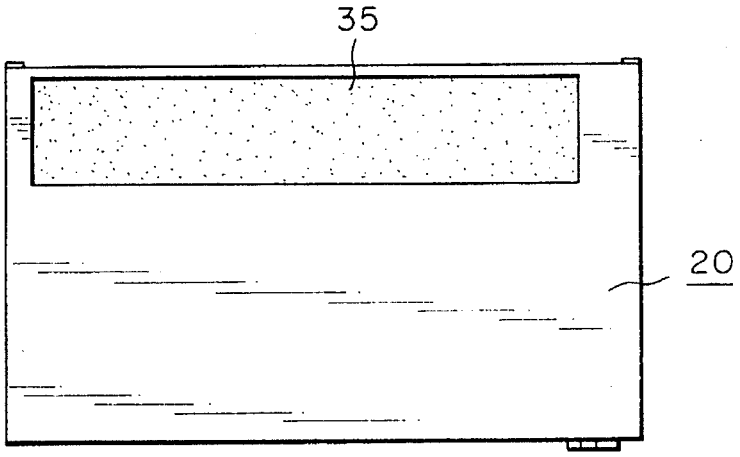
FIG. 12 shows a top plan view of the second preferred embodiment of the present invention.

As shown in FIGS. 11 and 12, the second preferred embodiment of the present invention is different from the first preferred embodiment of the present invention in that the former comprises an air flow guiding box 30 having an air exit which is provided with a long filtration member 35 capable of purifying the cooking fume so as to minimize the air pollution.

Figure 13:
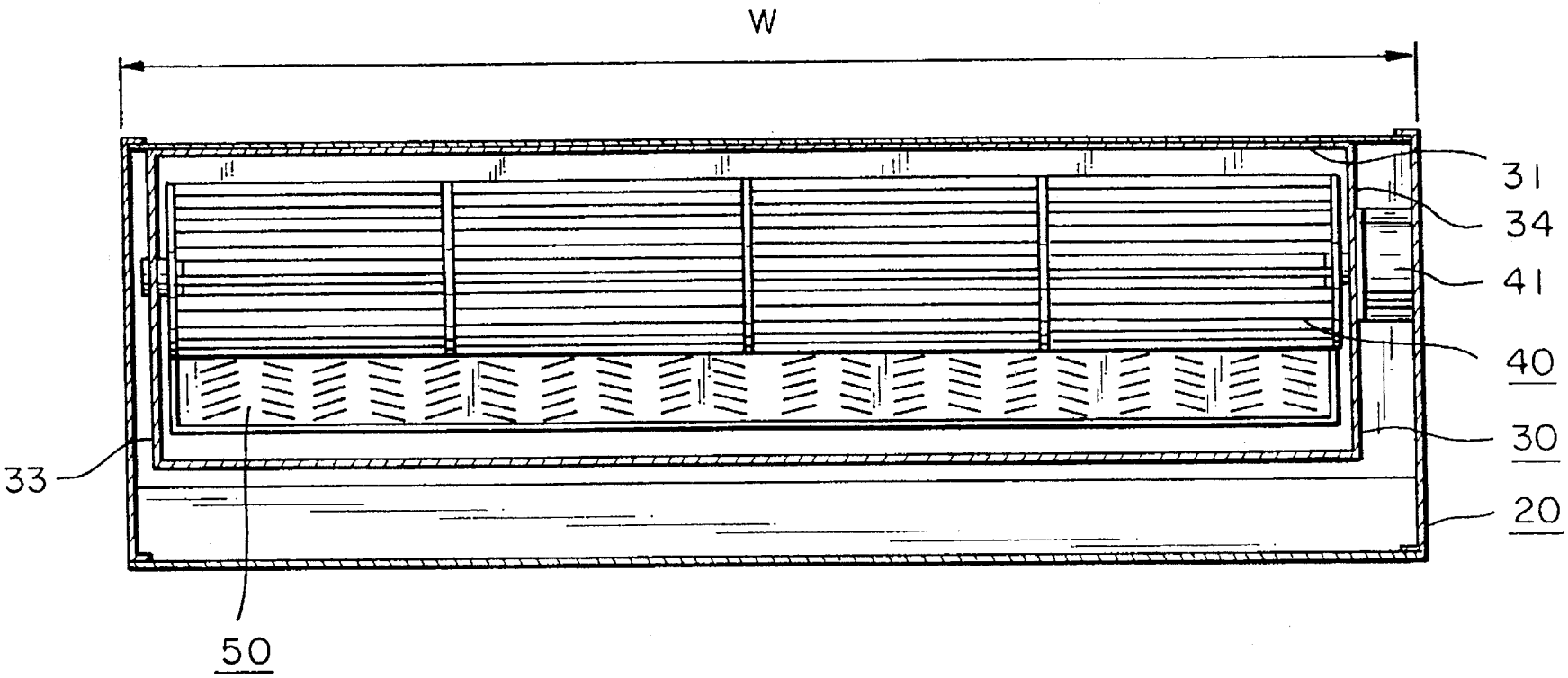
FIG. 13 shows a schematic view of a third preferred embodiment of the present invention.

As illustrated in FIG. 13, the third preferred embodiment of the present invention differs from the first preferred embodiment of the present invention in that the former comprises a housing 20 having a width which is a distance from the left side to the right side of the housing 20 and is about twice as wide as that of the housing of the latter, and that the former comprises an impeller 40 of a quaternary-section type for bringing about an all-out suction effect. The third preferred embodiment of the present invention is intended for use in conjunction with a gas or electric range. The number of section of the impeller 40 of the third preferred embodiment may be increased in accordance with the cooking requirements.

Figure 14:
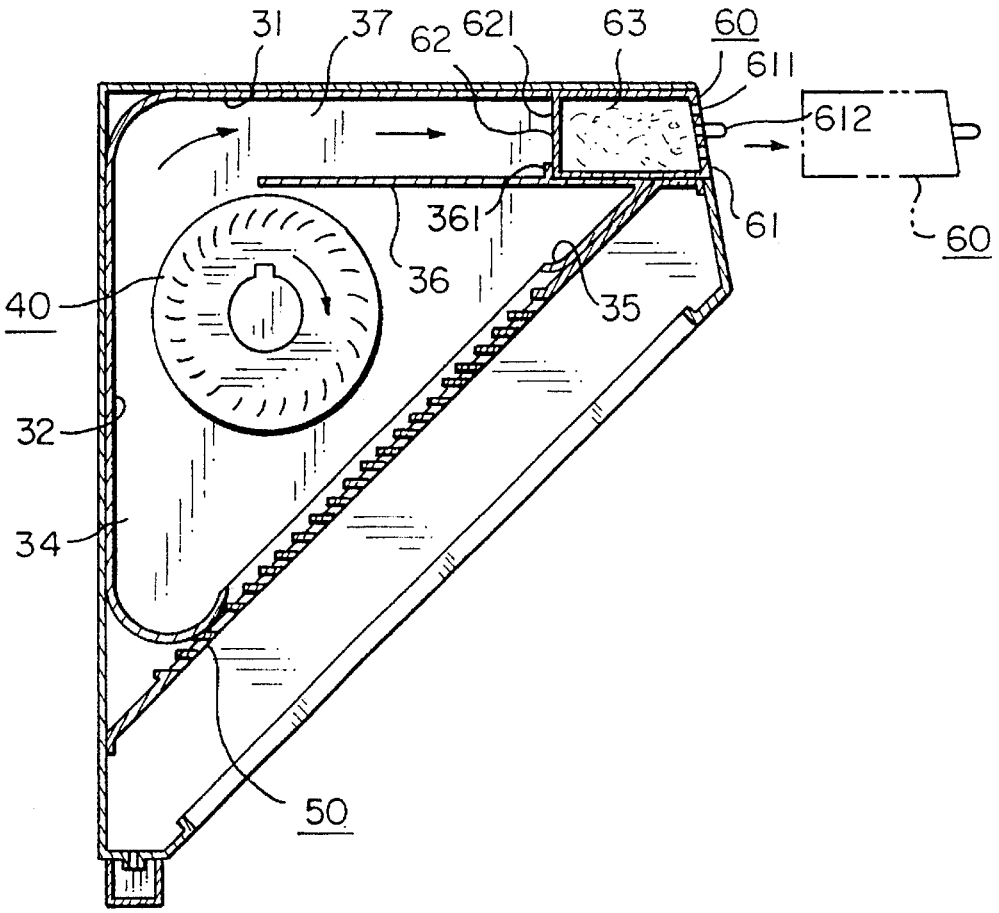
FIG. 14 shows a schematic view of a fourth preferred embodiment of the present invention.
Figure 15:
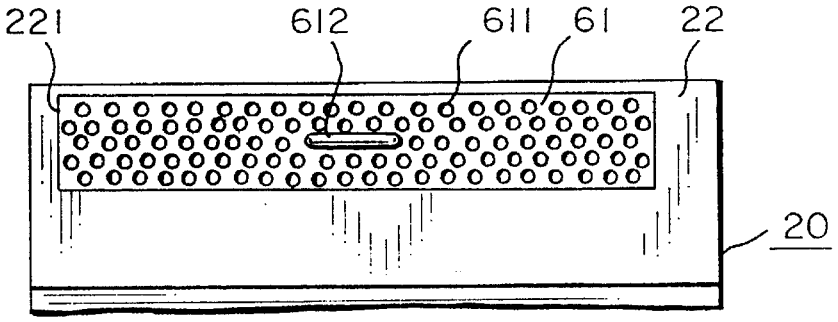
FIG. 15 shows a partial front view of the fourth preferred embodiment as shown in FIG. 14.

The fourth preferred embodiment of the present invention is shown in FIGS. 14 and 15 and is different from the first preferred embodiment of the present invention in that the former comprises an air flow guiding box 30 having a front plate 35 which is not connected at the top edge thereof with the front edge of a top plate 31, and that the former further comprises a locating plate 36 extending rearwards and horizontally. The locating plate 36 is located under the top plate 31 such that the rear edge of the locating plate 36 is kept an appropriate distance away from a rear plate 32, and that the locating plate 36 forms, along with the top plate 31, the left plate 33 and the right plate 34, an air exit duct 37 of a rectangular cross section. In addition, the front plate 22 of the housing 20 is provided with an opening 221 corresponding in location to the air exit duct 37, so as to facilitate the disposing of a box-type filtration member 60 in the air exit duct 37 via the opening 221. The filtration member 60 is located securely by a holding member 361 disposed on the top of the locating plate 36. The front plate 61 and the rear plate 62 of the filtration member 60 are provided respectively with a plurality of ventilation holes 611, 612. The front plate 61 is further provided with a grip 612. The filtration member 60 contains therein a filtration material 63 of active carbon and can be so pulled out as to facilitate the cleaning or the replacing of the dirty filtration material 63, as illustrated in FIG. 14. The constructional design of the filtration member 60 is superior in convenience to that of the embodiment which is illustrated in FIGS. 11 and 12.

Figure 16:
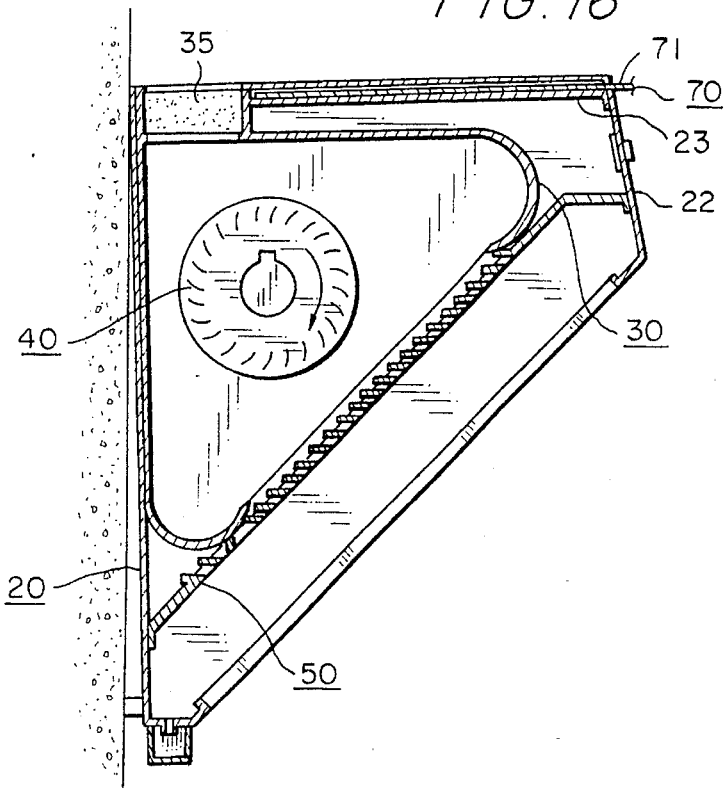
FIG. 16 shows a schematic view of a fifth preferred embodiment of the present invention.
Figure 17:
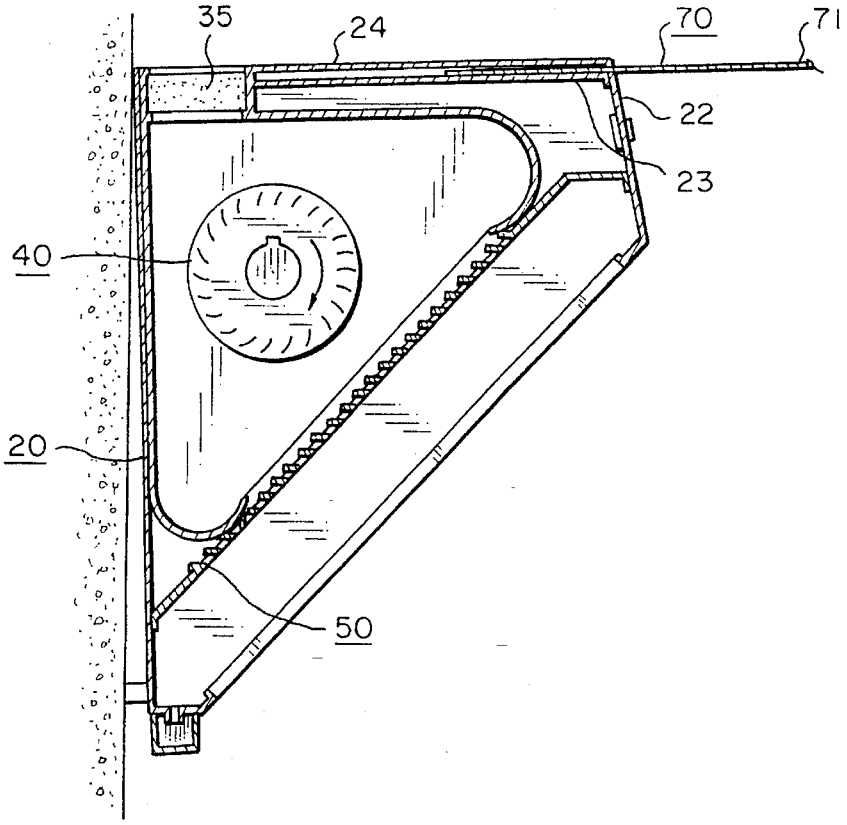
FIG. 17 shows a schematic view of the fifth preferred embodiment at work according to the present invention.

The fifth preferred embodiment of the present invention is shown in FIGS. 16 and 17 and is similar in construction to the second preferred embodiment of the present invention. The fifth preferred embodiment of the present invention comprises a housing 20 in which a receiving compartment 24 is formed by a plate member 23. The front plate 22 of the housing 20 is provided with a long slot corresponding in location to the receiving Compartment 24. A rectangular fume-obstructing plate member 70 is inserted into the receiving compartment 24 via the long slot. As shown in FIG. 17, the fume-obstructing plate member 70 is pulled out appropriately for enhancing the suction effect at such time when the cooking is under way. The fume-obstructing plate member 70 is intended to prevent the cooking fume from escaping upwardly in front of the front plate. In addition, the fume-obstructing plate member 70 is provided at the front section thereof with a round hole 71 dimensioned to receive therein a person's finger for pushing or pulling the fume-obstructing plate member 70.

While the invention has been described in connection with what is presently considered to be the most practical and preferred embodiments, it is to be understood that the invention is not to be limited to the disclosed embodiments but on the contrary, is intended to cover various moditications and equivalent arrangements included within the spirit and scope of the appended claims which scope is to be accorded the broadest interpretation so as to encompass all such modifications and equivalent structures.

What is claimed is:

1. A fume exhausting device comprising:

a housing provided therein with a receiving space, said housing further provided at a front side thereof with an opening;

an air flow guiding box disposed in said housing and made up of a front plate, a top plate, a rear plate, a left plate and a right plate, said guiding having an air exit and said front plate having an opening;

a transverse impeller located horizontally in said air flow guiding box such that said impeller is pivoted respectively at a left end thereof and at a right end thereof to said left plate and said right plate of said air flow guiding box, and that said impeller can be driven at one end thereof by a motor; and a bottom plate fastened to said housing such that said opening of said front plate of said air flow guiding box is sealed off by said bottom plate which is provided with a plurality of ventilation holes.

2. A fume exhausting device according to claim 1, wherein said transverse impeller has at least one section, depending on a width of said housing, said width being a distance from a left end of said housing to a right end of said housing.

3. A fume exhausting device according to claim 1, wherein said left plate or said right plate of said air flow guiding box is kept a predetermined distance from a side plate of said housing for locating said motor, said side plate of said housing facing said left plate or said right plate of said air flow guiding box.

4. A fume exhausting device according to claim 1, wherein said air exit of said air flow guiding box is provided with a filtration member.

5. A fume exhausting device according to claim 2, wherein said impeller has a section number of 2.

6. A fume exhausting device according to claim 2, wherein said impeller has a section number of 3.

7. A fume exhausting device according to claim 1, wherein said front plate of said air flow guiding box is spaced at a top edge thereof from a front edge of said top plate of said air flow guiding box; wherein said air flow guiding box is provided under said top plate with a locating plate extending rearwards and horizontally such that a rear edge of said locating plate is kept an appropriate distance from said rear plate and that said locating plate forms an air exit duct in conjunction with said top plate, said left plate and said right plate; and wherein said housing is provided in said front plate thereof with an opening corresponding in location to said air exit duct for disposing a filtration member in an outer section of said air exit duct via said opening.

8. A fume exhausting device according to claim 7, wherein said filtration member is of a boxlike construction and is provided with a front filtration plate and a rear filtration plate, which are in turn provided respectively with a plurality of ventilation holes; and wherein said filtration member is provided therein with a filtration material.

9. A fume exhausting device according to claim 1, including means for forming a receiving compartment in said housing; and wherein said housing is provided in a front guiding box plate adjacent said front side of said housing thereof with a slot through which a fume obstructing place member is inserted into said receiving compartment.

10. A fume exhausting device according to claim 4, wherein said transverse impeller has at least one section, depending on a width of said housing, said width being a distance from a left end of said housing to a right end of said housing.

11. A fume exhausting device according to claim 10, wherein said left plate or said right plate of said air flow guiding box is kept a predetermined distance from a side plate of said housing for locating said motor, said side plate of said housing facing said left plate or said right plate of said air flow guiding box.

12. A fume exhausting device according to claim 11, wherein said impeller has a section number of 2.

13. A fume exhausting device according to claim 11, wherein said impeller has a section number of 3.

14. A fume exhausting device according to claim 11, wherein said impeller has a section number of 4.

15. A fume exhausting device according to claim 7, wherein said transverse impeller has at least one section, depending on a width of said housing, said width being a distance from a left end of said housing to a right end of said housing.

16. A fume exhausting device according to claim 15, wherein said left plate or said right plate of said air flow guiding box is kept a predetermined distance from a side plate of said housing for locating said motor, said side plate of said housing facing said left plate or said right plate of said air flow guiding box.

17. A fume exhausting device according to claim 16, wherein said impeller has a section number of 2.

18. A fume exhausting device according to claim 16, wherein said impeller has a section number of 3.

19. A fume exhausting device according to claim 16, wherein said impeller has a section number of 4.

20. A fume exhausting device according to claim 9, wherein said transverse impeller has at least one section, depending on a width of said housing, said width being a distance from a left end of said housing to a right end of said housing.

21. A fume exhausting device according to claim 20, wherein said left plate or said right plate of said air flow guiding box is kept a predetermined distance from a side plate of said housing for locating said motor, said side plate of said housing facing said left plate or said right plate of said air flow guiding box.

22. A fume exhausting device according to claim 21, wherein said impeller has a section number of 2.

23. A fume exhausting device according to claim 21, wherein said impeller has a section number of 3.

24. A fume exhausting device according to claim 21, wherein said impeller has a section number of 4.

* * * * *